US005487880A

United States Patent [19]

Taylor et al.

[11] Patent Number: 5,487,880

[45] Date of Patent: Jan. 30, 1996

[54] PRODUCTION OF SODIUM-22 FROM PROTON IRRADIATED ALUMINUM

[75] Inventors: Wayne A. Taylor; Richard C. Heaton; David J. Jamriska, all of Los Alamos, N.M.

[73] Assignee: The Regents of the Unviersity of California Office of Technology Transfer, Alameda, Calif.

[21] Appl. No.: 160,601

[22] Filed: Nov. 30, 1993

[51] Int. Cl.[6] ..... C01G 57/00

[52] U.S. Cl. ..... 423/2; 423/202; 376/195

[58] Field of Search ..... 423/2, 179, 249, 423/202; 376/195

[56] References Cited

U.S. PATENT DOCUMENTS 4,894,208 1/1990 Griffin et al. ..... 423/2

*Primary Examiner*—Ngoclan Mai
*Attorney, Agent, or Firm*—Burce H. Cottrell

[57] ABSTRACT

A process for selective separation of sodium-22 from a proton irradiated aluminum target including dissolving a proton irradiated aluminum target in hydrochloric acid to form a first solution including aluminum ions and sodium ions, separating a portion of the aluminum ions from the first solution by crystallization of an aluminum salt, contacting the remaining first solution with an anion exchange resin whereby ions selected from the group consisting of iron and copper are selectively absorbed by the anion exchange resin while aluminum ions and sodium ions remain in solution, contacting the solution with an cation exchange resin whereby aluminum ions and sodium ions are adsorbed by the cation exchange resin, and, contacting the cation exchange resin with an acid solution capable of selectively separating the adsorbed sodium ions from the cation exchange resin while aluminum ions remain adsorbed on the cation exchange resin is disclosed.

5 Claims, No Drawings

PRODUCTION OF SODIUM-22 FROM PROTON IRRADIATED ALUMINUM

FIELD OF THE INVENTION

The present invention relates to the field of selective separation of radioisotopes. More particularly, the present invention relates to the selective separation of sodium-22 from an irradiated aluminum target. This invention is the result of a contract with the Department of Energy (Contract No. W-7405-ENG-36).

BACKGROUND OF THE INVENTION

Sodium-22 is well suited as a radioactive tracer due to its relatively long half life (about 2.6 years) and its strong gamma ray emission (about 1275 KeV) with 99.9 percent abundance. Its uses as a radioactive tracer are principally in biological and geological fields, e.g., as a radioactive tracer for logging data in subterranean formations such as oil wells. Additionally, sodium-22 can be used in intense slow positron beams.

Proton irradiation of targets for radioisotope production is a common process. Often, in the proton irradiation of, e.g., molybdenum or rubidium bromide, the target material is encapsulated in aluminum or an aluminum alloy. The irradiation of the aluminum in such encapsulation material results in the production of sodium-22. However, no convenient separation process has previously been known, especially a separation process from aluminum alloys.

U.S. Pat. No. 4,894,208 describes a distillation process of separating sodium-22 from aluminum, a process which is vastly different from the presently described process. Additionally, it is described that the distillation process requires the use of a graphite cup as molten aluminum forms alloys with metal, e.g., Monel alloy, cups from which sodium does not distill.

It is an object of the present invention to provide a process of separating sodium-22 from an irradiated aluminum target and especially from an irradiated aluminum alloy target.

SUMMARY OF THE INVENTION

To achieve the foregoing and other objects, and in accordance with the purposes of the present invention, as embodied and broadly described herein, the present invention provides a process for selective separation of sodium-22 from a proton irradiated aluminum target including dissolving a proton irradiated aluminum target to form a first solution including aluminum ions and sodium ions, separating a portion of the aluminum ions from the first solution by crystallization of an aluminum salt, contacting the remaining first solution with an anion exchange resin whereby ions selected from the group consisting of iron and copper are selectively absorbed by the anion exchange resin while aluminum ions and sodium ions remain in solution, contacting the solution with an cation exchange resin whereby aluminum ions and sodium ions are adsorbed by the cation exchange resin, and, contacting the cation exchange resin with an acid solution capable of selectively separating the adsorbed sodium ions from the cation exchange resin while aluminum ions remain adsorbed on the cation exchange resin.

DETAILED DESCRIPTION

The present invention is concerned with the selective separation of sodium-22 from a previously irradiated target, e.g., a proton irradiated aluminum target. Such a process can produce up to curie quantities of sodium-22 for use in the field of nuclear chemistry, e.g., as a radioactive tracer.

As a starting material in the present process, an aluminum target is irradiated by energetic protons having energies sufficient to generate a large number of isotopes by spallation reactions, generally energies greater than about 200 MeV, more preferably from about 600 MeV to about 800 MeV. In order to produce the desired millicurie to curie quantities of the radioisotopes, the aluminum target should have a weight of at least about 100 grams (g).

One method of irradiation is by proton bombardment of the aluminum target. Such proton bombardment can be accomplished by inserting the target into a linear accelerator beam at a suitable location whereby the target is irradiated at an integrated beam intensity of from about 30 milliampere-hours (mA-hr) to about 1000 mA-hr. After the irradiation of the aluminum target, the target is generally allowed to decay for at least from about 7 to about 14 days whereby unwanted short-lived isotopes will be substantially removed.

Aluminum, or more usually an aluminum alloy, has often been used as an encapsulation material for other materials subjected to such a high energy irradiation process. The aluminum or aluminum alloy material used in encapsulating other target materials can be used in the recovery or selective separation of sodium-22 without the need for a separate aluminum target. Aluminum alloys used in encapsulating other target materials often include alloying materials such as copper, zinc, iron, vanadium, zirconium, titanium and the like.

In the selective separation of the present invention, the irradiated aluminum target is initially dissolved into a suitable acid solution, e.g., a hydrochloric acid solution, by either a batch or continuous process. Preferably, the dissolution is by a batch process. The hydrochloric acid solution can be of any convenient concentration, although concentrated solutions, i.e., concentration of greater than about 6 Molar hydrochloric acid are preferred for quicker dissolution.

The resultant solution from the dissolution of the target contains a high concentration of aluminum ions together with smaller concentrations of the ions from the other alloying metals and the sodium-22 and other isotopes generated during the irradiation. Initially, the solution can be concentrated by evaporation of a portion of the water whereupon a solution saturated or supersaturated in an aluminum salt, e.g., aluminum chloride ($AlCl_3$), is eventually generated. The generated crystals of the aluminum salt, e.g., aluminum chloride, can be filtered from the remaining solution and washed with concentrated hydrochloric acid. The filtrate and washings are retained and subjected to further crystallizations of, e.g., aluminum chloride either by further concentration via evaporation or by addition of concentrated hydrochloric acid to increase the concentration of the chloride anions and thus decrease the solubility of the aluminum chloride. By careful repeated crystallizations, a significant portion of the aluminum ions can be removed from the solution while largely excluding the removal of sodium ions from the solution.

The remaining solution is then contacted with an anion exchange resin, preferably by passing the solution through a bed of the anion exchange resin. Generally, prior to contact with the resin, the solution is converted to a strong or highly acidic solution, e.g., by first evaporating to dryness followed by redissolution in, e.g., from about 6 Molar to about 10 Molar hydrochloric acid, preferably about 8 Molar hydrochloric acid. The anion exchange resin can be, e.g., a strongly basic anion exchange resin such as AG-1X8, available from Bio-Rad Laboratories. As the solution is passed through the anion exchange resin, metal complexes of, e.g., iron and copper will be adsorbed by the resin, while the solution will retain the aluminum and sodium ions. The majority of the iron and copper present in the solution can be removed at this stage.

The remaining solution is then contacted with a cation exchange resin, preferably by passing the solution through a bed of the cation exchange resin. The cation exchange resin can be, e.g., a macroporous cation exchange resin such as AG-MP-50, available from Bio-Rad Laboratories. After the solution is passed through the cation exchange resin, the aluminum and sodium as well as additional contaminants such as rubidium, copper, beryllium, and vanadium will be adsorbed by the resin. The resin bed is then washed with successive fractions of an acid solution, preferably a dilute acid solution, to strip or selectively separate the sodium-22 from the cation exchange resin while leaving the remainder of the metal ions upon the resin. Hydrochloric acid is generally preferred as the acid for the stripping step. Generally, the dilute acid solution can be from about 0.1 Molar to about 1.0 Molar hydrochloric acid, preferably from about 0.1 Molar to about 0.5 Molar. If necessary, multiple cation exchange columns can be used where necessary for effective separation.

Optionally, the final solution can then be cleaned up to eliminate any resin throw, i.e., traces of the cation exchange resin, by contacting the remaining solution with another anion exchange resin, preferably by passing the solution through a bed of the anion exchange resin. The anion exchange resin can again be, e.g., a strongly basic anion exchange resin such as AG-1X8.

The present invention is more particularly described in the following example which is intended as illustrative only, since numerous modifications and variations will be apparent to those skilled in the art.

EXAMPLE 1

Portions of an aluminum target encapsulation material which had been irradiated with 600–800 MeV protons at an integrated beam intensity of about 590 mA-hr were cut into small pieces, each piece approximately 50 grams (g). Two 50 g pieces of irradiated aluminum were dissolved, each piece dissolved in steps with minor heating in about 500 milliliters (ml) of concentrated hydrochloric acid (HCl) and about 250 ml of water. The solutions were each filtered and the residue washed with 0.1 Molar (M) HCl, the washings combined with the filtrate. The solutions were then combined and used as the starting material for the separation of sodium-22.

The solution was initially divided into three 650 ml batches. Each solution was evaporated down until the solutions were saturated in aluminum chloride ($AlCl_3$ ). The solutions were then allowed to cool. The resulting crystals were filtered from the solution, washed with concentrated HCl, and discarded. The washes and filtrates from the three batches were combined and evaporated down so that a second crystallization and filtration were performed. In the same manner, the resulting wash and filtrate were combined and a third crystallization and filtration were performed.

The resulting filtrate and wash were again combined, then evaporated to dryness and then redissolved in 500 ml of 8 M HCl. This solution was passed through a 250 ml anion exchange resin column (AG-1X8) to remove stable copper as well as other alloying agents such as iron and zinc. The column was rinsed with four 50 ml fractions of 8M HCl. The last fractions contained some copper so they were evaporated to dryness, redissolved in 8M HCl and passed through a second 250 ml anion exchange resin column (AG-1X8), followed by three 50 ml washes of 8M HCl. These anion exchange columns removed most of the copper as well as other alloying agents such as iron and zinc.

Subsequent crystallizations were then undertaken. The fractions from the anion exchange column containing measurable sodium-22, as determined by an intrinsic germanium detector, were combined and evaporated to dryness. The resulting solids were admixed with water and the solution or suspension was converted to a 6M HCl solution by addition of concentrated HCl. This acidic solution was evaporated down to about 100 ml and allowed to cool. To this solution 250 ml of chilled concentrated HCl was added whereby a precipitate formed. The resultant crystals were filtered and washed with chilled concentrated HCl. As these crystals contained a measurable amount of sodium-22, they were redissolved in water, more concentrated HCl added and the same crystallization and filtration process performed. At this point, the resultant crystals were discarded, the filtrate and washes combined and three more crystallizations performed. Each time the aluminum chloride crystals were discarded and the filtrate and washes combined for the next crystallization.

The remaining solution was then evaporated to dryness and redissolved in 500 ml of water. This solution was placed onto a one liter macroporous cation exchange resin column (AG MP-50) and washed with fourteen 500 ml fractions of 0.2M HCl. At this step, all of the rubidium and the last of the copper were removed. Fractions 5 through 14 were combined and taken to dryness. The solids were again taken up in 500 ml of water and placed on a one liter macroporous cation exchange column (AG MP-50). The column was then rinsed with twenty-nine 500 ml fractions of 0.5M HCl. Fractions 11 through 26 were combined and evaporated to dryness. At this point the last traces of aluminum, beryllium-7 and vanadium-48 had been removed.

The solids were redissolved in about 25 ml of water and passed through a 12 ml anion exchange column (AG-1X8) followed by 25 ml of 0.1M HCl to remove traces of the cation resin. The resulting solutions were combined, evaporated to dryness and redissolved in about 20 ml of water. This final solution was assayed as the product. The assay showed radiochemical pure sodium-22 with traces of calcium.

Although the present invention has been described with reference to specific details, it is not intended that such details should be regarded as limitations upon the scope of the invention, except as and to the extent that they are included in the accompanying claims.

What is claimed is:

1. A process for selective separation of sodium-22 from a proton irradiated aluminum target comprising:

dissolving a proton irradiated aluminum target to form a first solution including aluminum ions and sodium ions;

separating a portion of the aluminum ions from the first solution by crystallization of an aluminum salt;

contacting the remaining first solution with an anion exchange resin whereby ions selected from the group consisting of iron and copper are selectively absorbed by the anion exchange resin while aluminum ions and sodium ions remain in solution;

contacting the solution with an cation exchange resin whereby aluminum ions and sodium ions are adsorbed by the cation exchange resin; and, contacting the cation exchange resin with an acid solution capable of selectively separating the adsorbed sodium ions from the cation exchange resin while aluminum ions remain adsorbed on the cation exchange resin.

2. The process of claim 1 wherein the aluminum target is an aluminum alloy target.

3. The process of claim 1 wherein said contacting the remaining first solution with an anion exchange resin is in a strong acidic solution.

4. The process of claim 1 wherein said dissolving a proton irradiated aluminum target is in hydrochloric acid.

5. The process of claim 1 wherein the process further comprises contacting the acid solution including the selectively separated sodium ions with an anion exchange resin thereby removing traces of cation exchange resin.

* * * * *